US011485540B2

(12) United States Patent
Piech

(10) Patent No.: US 11,485,540 B2
(45) Date of Patent: Nov. 1, 2022

(54) METALLIC CAN END

(71) Applicant: TOP CAP HOLDING GMBH, Kufstein (AT)

(72) Inventor: Gregor Anton Piech, Reith bei Kitzbuhel (AT)

(73) Assignee: TOP CAP HOLDING GMBH, Kufstein (AT)

( * ) Notice: Subject to any disclaimer, the term of this patent is extended or adjusted under 35 U.S.C. 154(b) by 28 days.

(21) Appl. No.: 17/254,622

(22) PCT Filed: Jun. 17, 2019

(86) PCT No.: PCT/EP2019/065890
§ 371 (c)(1),
(2) Date: Dec. 21, 2020

(87) PCT Pub. No.: WO2019/243260
PCT Pub. Date: Dec. 26, 2019

(65) Prior Publication Data

US 2021/0114767 A1 Apr. 22, 2021

(30) Foreign Application Priority Data

Jun. 19, 2018 (EP) ..... 18178561

(51) Int. Cl.
*B65D 17/28* (2006.01)
*B65D 53/02* (2006.01)

(52) U.S. Cl.
CPC ..... *B65D 17/4014* (2018.01); *B65D 53/02* (2013.01); *B65D 2401/15* (2020.05);
(Continued)

(58) Field of Classification Search
CPC ..... B65D 17/4014; B65D 53/02; B65D 2401/15; B65D 2517/0013;
(Continued)

(56) References Cited

U.S. PATENT DOCUMENTS 5,819,973 A * 10/1998 Traub, Sr. ..... B65D 17/4012 220/269
9,296,538 B2 * 3/2016 El-Afandi ..... B65D 17/4012
(Continued)

FOREIGN PATENT DOCUMENTS

DE 102010013531 A1 1/2018
DE 102015112428 A1 1/2018
(Continued)

OTHER PUBLICATIONS

English translation of DE 102010013531 provided by Espacenet. (Year: 2022).*
(Continued)

*Primary Examiner* — James N Smalley
(74) *Attorney, Agent, or Firm* — Vivacqua Crane, PLLC

(57) ABSTRACT

A metallic can end having a reclosable opening, a microgap or weakening line provided in the metallic end surface and peripheral about the opening, a sealing frame connected to the end surface and surrounding the opening region, a closure unit connected to the upwardly pivotable metal end region disposed within the microgap or weakening line, that is pivotably attached to the end surface via a pivot bearing. The sealing frame and the closure unit are composed of plastic material and cooperate in a sealing manner with one another via sealing and latching ribs that form sealing edges with associated reception grooves. The metallic can region disposed within the peripheral microgap or weakening line is received and held in the opening region of the end. The sealing edges are configured such that the radially innermost sealing edge still seals when the radially outer sealing edges have just been released.

11 Claims, 3 Drawing Sheets

(52) U.S. Cl.
CPC ..... *B65D 2517/0013* (2013.01); *B65D 2517/0044* (2013.01); *B65D 2517/0046* (2013.01); *B65D 2517/0062* (2013.01)

(58) Field of Classification Search
CPC .... B65D 2517/0044; B65D 2517/0046; B65D 2517/0062
USPC ..... 220/254.9, 270
See application file for complete search history.

(56) References Cited

U.S. PATENT DOCUMENTS

| | | | |
|---|---|---|---|
| 2004/0159665 | A1 | 8/2004 | Morrissey et al. |
| 2013/0020326 | A1 | 1/2013 | Thielen et al. |
| 2018/0016058 | A1 | 1/2018 | Thielen et al. |

FOREIGN PATENT DOCUMENTS

| | | | |
|---|---|---|---|
| EP | 1607341 | A1 | 12/2005 |
| EP | 2354021 | B1 | 12/2012 |
| EP | 2354022 | B1 | 12/2012 |
| JP | 2018526294 | A | 9/2018 |
| JP | 2019507074 | A | 3/2019 |
| KR | 20000058566 | A | 10/2000 |

OTHER PUBLICATIONS

English translation of EP2354021A1 from Espacenet. (Year: 2022).*
English translation of EP2354022A1 from Espacenet. (Year: 2022).*
International Search Report, Application No. PCT/EP2019/065890, dated Sep. 4, 2019.

* cited by examiner

Fig.7
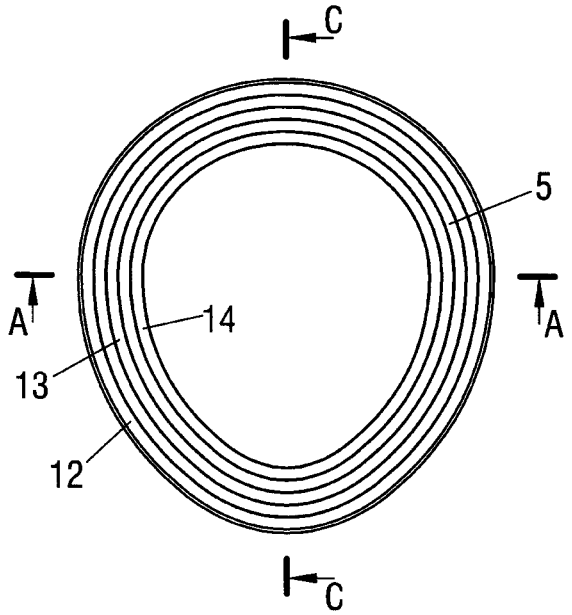
Fig.8
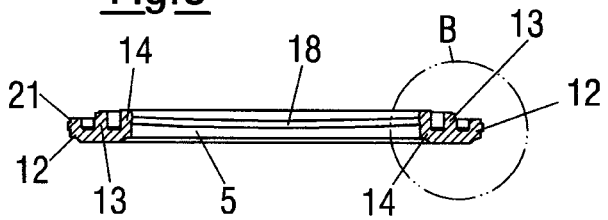
Fig.9
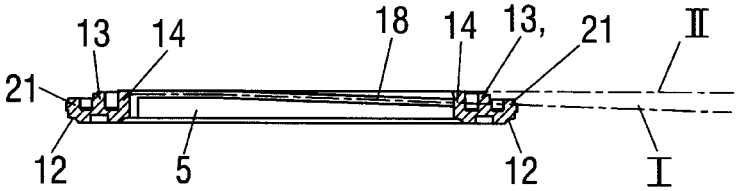
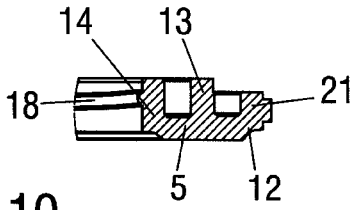
Fig.10

METALLIC CAN END

CROSS REFERENCE TO RELATED APPLICATIONS

This application is a national stage application under 35 U.S.C. 371 of PCT Application No. PCT/EP2019/065890 having an international filing date of 17 Jun. 2019, which PCT application claimed the benefit of European Patent Application No. 18178561.9 filed 19 Jun. 2018, the entire disclosure of each of which are hereby incorporated herein by reference.

TECHNICAL FIELD

The present invention relates to a metallic can end having a reclosable opening, in particular for beverage cans and for containers for storing foodstuffs and other liquid, pasty, powdery and/or solid products.

INTRODUCTION

A can end having a reclosable opening is known from EP 1 607 341 A1 in which an opening is introduced in the metallic can end and the margin of this opening is beaded to create an anchorage possibility for a prefabricated plastic closure part. The plastic closure part includes a base part which is to be connected to the bead margin of the can opening and in which an opening closed by a flat stopper is formed. The flat stopper is connected to the opening margin via a plastic tear seam so that the flat stopper connected to a tear tab can be released from the base plastic part via the tear tab by exertion of a pull and can be pivoted into an opening position. The opening can be temporarily closed again by pressing in the flat stopper which is preferably conical at its lower side.

Reclosable can ends are furthermore described, for example, in DE 10 2010 013 531 A1, DE 10 2015 112 428 A1 and EP 2 354 022 B1.

SUMMARY

It is the object of the invention to provide a reclosable can end that is particularly favorable in manufacture and that, on the one hand, is nevertheless particularly easy to actuate and, on the other hand, has good sealing properties.

This object is satisfied by a metallic can end having the features of claim 1.

A microgap ensures a particularly simple opening of the can end, but a weakening line is also generally suitable. An effective closure and reclosing can be achieved via the sealing and latching ribs and via the associated reception grooves. It is particularly advantageous in this respect that the sealing frame is bonded to the fixed end surface and that the closure unit is bonded to the upwardly pivotable metallic end region.

In accordance with the invention, the sealing and latching ribs form at least two, preferably three, sealing edges with the reception grooves, with the sealing edges being configured such that on the opening of the can end, the radially innermost sealing edge still seals when the radially outer sealing edge or both radially outer sealing edges have just been released. A so-called venting of a can closed by the can end can be achieved in this manner, that is a slow pressure drop before the complete opening of the can end.

In accordance with a preferred embodiment of the invention, the radially innermost sealing edge has a larger distance from the end surface than the other sealing edge or than the two other sealing edges. The innermost sealing edge thereby releases after the other sealing edge or after the two other sealing edges so that said venting is achieved.

In accordance with a particularly preferred embodiment of the invention, at least the radially innermost sealing edge extends in a plane that is inclined with respect to the plane of the end region disposed within the microgap or the weakening line, with the two planes having the greatest distance from one another on the side remote from the pivot bearing. It can be achieved by this embodiment that the innermost sealing edge seals over its total periphery for so long until the outer sealing edge or the two outer sealing edges have been released.

In accordance with a further embodiment of the invention that is also claimed per se, the sealing and latching ribs, on the one hand, and the reception grooves, on the other hand, are configured such that they increasingly interlock with one another with an upwardly arching can end. It can hereby be ensured that the can end also remains closed on an increasing internal pressure in the can.

In accordance with a preferred embodiment of this idea of the invention, a latching rib provided at the sealing frame has an outwardly facing hook that cooperates with a correspondingly inwardly facing latch projection of a receiver of the closure unit. An increasing interlocking with upwardly arching can ends is achieved by this embodiment.

In accordance with yet another embodiment of the invention that is likewise also claimed per se, the tear-open member has an aperture into which a prolongation of the closure unit engages, with the prolongation being connected to the tear-open members so firmly, in particular bonded, that the prolongation is torn off from the closure unit on the upward pivoting of the tear-open member. An originality closure is created by this embodiment, that is a closure whose opening is recognizably irreversible.

In accordance with a particularly preferred further development of this idea of the invention, the aperture and the prolongation are provided in the region of the pivot bearing of the tear-open part. It is hereby achieved that the tearing off of the prolongation already takes place on the raising of the tear-open part so that every manipulation of the can end can be prevented.

BRIEF DESCRIPTION OF THE DRAWINGS

An embodiment of the invention is represented in the drawing and will be described in the following. There are shown, schematically in each case FIG. 1 a perspective view of a can end in accordance with the invention;

FIG. 7 a plan view of sealing frame of a can end in accordance with the invention;

FIG. 8 a section in accordance with the line A-A in FIG. 7;

FIG. 9 a section in accordance with the line C-C in FIG. 7; and

FIG. 10 detail B of FIG. 8 at an increased scale.

DETAILED DESCRIPTION

Figure 1:
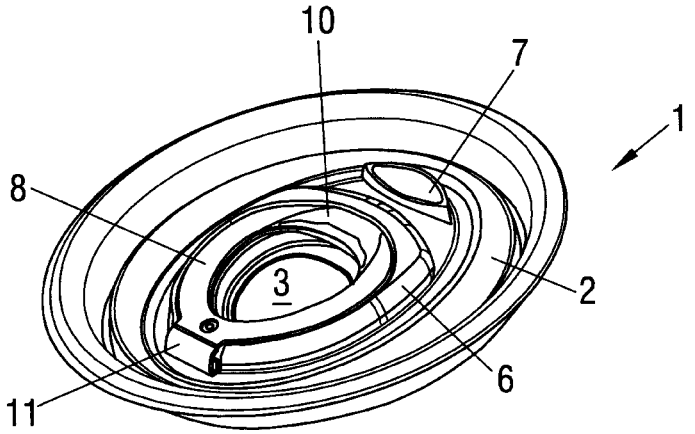

The can end 1 shown in the Figures comprises metal, in particular aluminum, and has a reclosable opening. An upwardly pivotable end region 3 is provided beside a fixed end surface 2 for this purpose. The upwardly pivotable end region 3 is separated from the fixed end region 2 by a peripheral microgap 4 or by a weakening line (see in particular FIG. 6).

A sealing frame 5 that is composed of plastic material and that surrounds the opening region is connected to the fixed end surface 2, and indeed in particular by a so-called hot melt process using a bonding agent to ensure a firm connection to the aluminum of the end. A closure unit 6 that is likewise composed of plastic and that is pivotably attached via a pivot bearing 7 to the fixed end surface 2 is furthermore connected to the upwardly pivotable metallic end region 3. The pivot bearing 7 and the closure unit 6 are in turn in particular connected to the fixed end surface 2 or to the upwardly pivotable end region 3 via a hot melt connection using a bonding agent.

The closure unit is connected at the side diametrically opposite the pivot bearing 7 to an upwardly pivotable tear-open member 8 that is arranged in parallel with the upper end side 9 in the non-upwardly pivoted state. The tear-open member 8 is formed as annular in a known manner and can be pivoted upwardly about a pivot bearing 11 by being engaged by a finger in an engagement end 10 opposite the end surface.

The sealing frame 5 and the closure unit 6 cooperate in a sealing manner via sealing and latching ribs 12, 13, 14 at the sealing frame 5 and via associated reception grooves 15, 16, 17 at the closure unit 6. Three sealing edges 18, 19, 20 are thereby formed by which the opening region of the can end is sealed. An imperviousness of the can end is thereby also ensured when using a microgap 4 between the upwardly pivotable end region 3 and the fixed end region 2.

Figure 6:
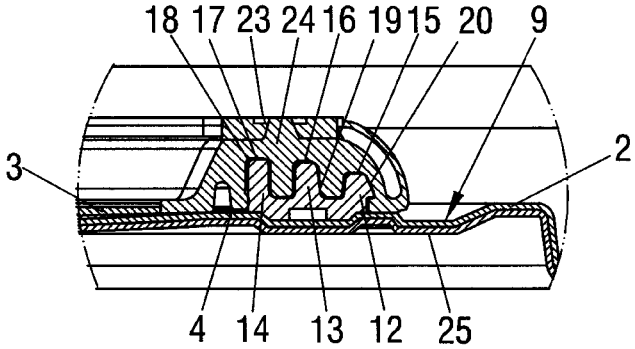
FIG. 6 detail D of FIG. 3 at an increased scale.

As can in particular be seen in FIG. 6, the radially innermost sealing edge 18 is further remote from the end surface than the two other sealing edges 19 and 20. The innermost sealing edge 18 therefore still seals when the two outer sealing edges 19 and 20 have already just been released on the opening of the can end. A so-called venting of the can interior, that is a slow pressure drop prior to the complete opening, can take place in this manner.

As can in particular be seen in FIGS. 9 and 10, the radially innermost sealing edge 18 extends in a plane I that is inclined with respect to the end plane II. The inclination here, for example, amounts to 1 to 2°, in particular to 1.5°. It is hereby ensured that the innermost sealing edge 18 still seals on the upward pivoting of the end region 3 over the total periphery of said sealing edge 18 when the two outer sealing edge 19, 20 have just released. It can hereby be prevented on the venting of the can interior that liquid moves from the can interior to the outside.

Figure 5:
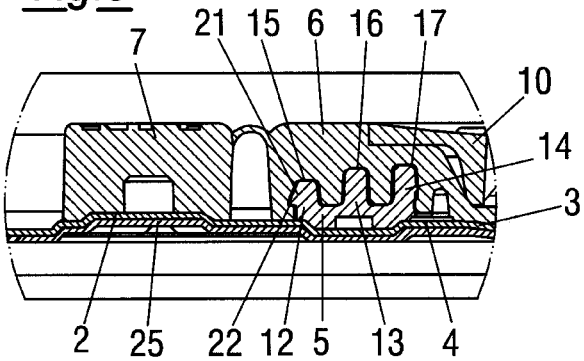
FIG. 5 detail C of FIG. 3 at an increased scale.

As can in particular be recognized in FIGS. 5 and 6, the radially outermost sealing and latching rib 12 provided at the sealing frame 5 has an outwardly facing hook 21 that cooperates with a correspondingly inwardly facing latching projection 22 of the associated receiver 15 of the closure unit 6. It is hereby achieved that the sealing and latching rib 12 increasingly interlocks with the receiver 15 or its latching projection when the can end arches upwardly, for example due to a rising internal pressure in the can.

Figure 2:
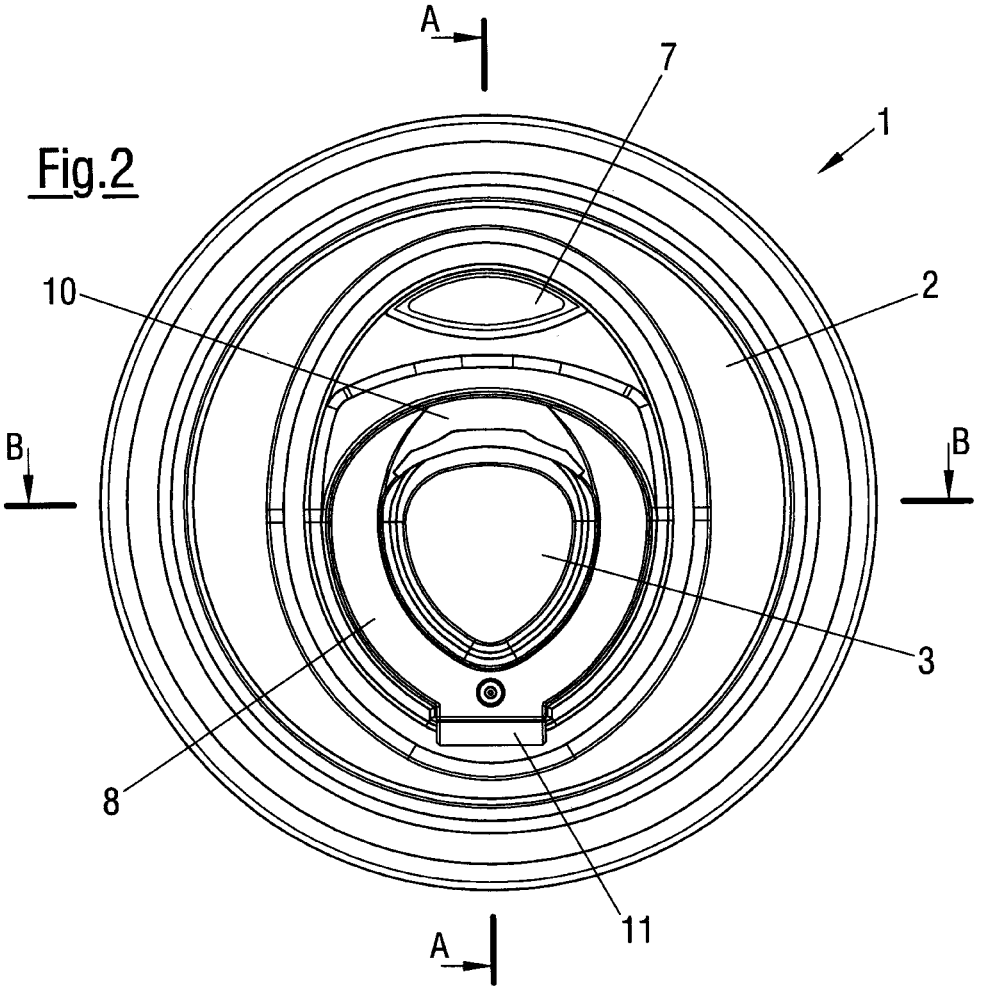
FIG. 2 a plan view of the upper side of the can end of FIG. 1.
Figure 3:
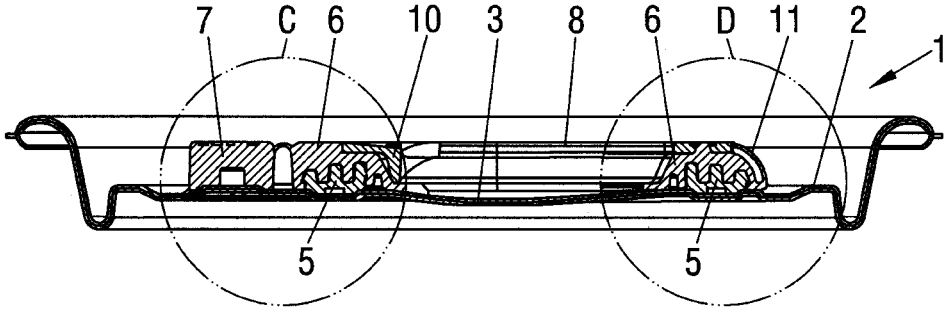
FIG. 3 a section in accordance with the line A-A in FIG. 2.
Figure 4:
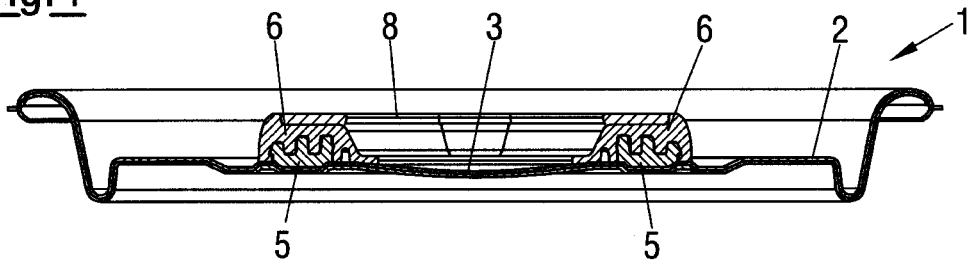
FIG. 4 a section in accordance with the line B-B in FIG. 2.

As can in particular be seen in FIGS. 2 and 6, the tear-open member 8 has an aperture 23 into which a prolongation 24 of the closure unit 6 engages. The prolongation 24 is so firmly connected to the tear-open member 8, in particular bonded, that the prolongation 24 is torn off from the closure unit 6 on the upward pivoting of the tear-open member 8. Such a firm connection can, for example, be achieved in that the prolongation 24 is initially melted after the injection molding of this plastic part such that it is firmly connected to the part of the tear-open member 8 forming the aperture 23. This can, for example, be achieved by a kind of soldering iron.

As can be recognized in FIG. 6, the aperture 23 and the prolongation 24 are provided in the region of the pivot bearing 11 of the tear-open member 8. It is thereby achieved that a small raising of the tear-open member 8 is already sufficient to tear off the prolongation 24.

In the embodiment shown, the inner side of the can end is laminated by a plastic film 25 that covers the total inner can side. Differing from this, the plastic film can also be formed as annular and can only extend a few tenths of a millimeter, in particular 3 to 4 tenths of a millimeter, at both sides beyond the microgap 4 or the weakening line. A different possibility comprises using a disk-shaped sealing film that extends a few tenths of a millimeter, for example 3 to 4 tenths of a millimeter, radially outwardly beyond the microgap 4 or the weakening line. The sealing film can be formed as a largely flat disk in this case. Both the annular and the disk-shaped sealing films are preferably formed as stamped parts.

Whereas the sealing frame 5 and the closure unit 6 are always attached to the outer side of the can end 1 and are connected to the can end via a bonding agent, the inner end side can also, differing from the embodiment, be at least largely free of laminations and the like. The inner end side can, however, be provided with a lacquer layer, in particular suitable for use in foodstuffs, to prevent a contact of the product contained in the can to the metallic end material.

As can in particular be recognized in FIGS. 5 and 6, the closure unit 6 bonded to the fixed end region 2 engages over the microgap 4. An imperviousness of the can end can also be achieved in this manner without a sealing film at the inner end side.

REFERENCE NUMERAL LIST

1 can end
2 fixed end region
3 upwardly pivotable end region
4 microgap
5 sealing frame
6 closure unit
7 pivot bearing
8 tear-open member
9 upper can side
10 engagement end
11 pivot bearing of 8
12 sealing and latching rib
13 sealing and latching rib
14 sealing and latching rib
15 reception groove
16 reception groove
17 reception groove
18 sealing edge
19 sealing edge

20 sealing edge
21 hook
22 projection
23 aperture
24 prolongation
25 sealing film
I plane
II plane

The invention claimed is:

1. A metallic can end comprising: a reclosable opening, a microgap or a weakening line provided in a fixed end surface and peripheral about an opening region, a sealing frame composed of plastic material connected to the fixed end surface and surrounding the opening region, a closure unit that is composed of plastic material, the closure unit being connected to an upwardly pivotable metallic end region disposed within the microgap or the weakening line, and the closure unit being pivotably attached to the fixed end surface via a pivot bearing, wherein the sealing frame and the closure unit cooperate in a sealing manner via sealing and latching ribs and associated reception grooves and the metallic end region disposed within the peripheral microgap or the weakening line is received and held in the opening region of the end, and wherein the sealing and latching ribs form at least two sealing edges with the reception grooves, and wherein the sealing edges are configured such that on opening of the can end, the radially innermost sealing edge still seals when the radially outer sealing edge or the radially outer sealing edges have just been released.

2. The metallic can end in accordance with claim 1, wherein the radially innermost sealing edge has a greater distance from the end surface than the other sealing edge or both the other sealing edges.

3. The metallic can end in accordance with claim 1, wherein the radially innermost sealing edge extends in a plane that is inclined with respect to the plane of the metallic end region disposed within the microgap or weakening line, with the two planes having the greatest distance from one another on a side of the metallic end region remote from the pivot bearing.

4. A metallic can end comprising: a reclosable opening, a microgap or weakening line provided in a fixed end surface and peripheral about an opening region, a sealing frame composed of plastic material connected to the fixed end surface and surrounding the opening region, a closure unit that is composed of plastic material, that is connected to an upwardly pivotable metallic end region disposed within the microgap or the weakening line, and that is pivotably attached to the fixed end surface via a pivot bearing, wherein the sealing frame and the closure unit cooperate in a sealing manner via sealing and latching ribs and associated reception grooves and the metallic end region disposed within the peripheral microgap or the weakening line is received and held in the opening region of the end, wherein the sealing and latching ribs form sealing edges with the reception grooves, and wherein the sealing and latching ribs, on the one hand, and the reception grooves, on the other hand, are configured such that they increasingly interlock with one another with an upwardly arching can end.

5. The metallic can end in accordance with claim 4, wherein a latching rib provided at the sealing frame has an outwardly facing hook that cooperates with a correspondingly inwardly facing latching projection of an associated reception groove of the closure unit.

6. A metallic can end comprising:

a reclosable opening, a microgap or weakening line provided in the metallic end surface and peripheral about the opening, a sealing frame composed of plastic material connected to the fixed end surface and surrounding the opening region, a closure unit that is composed of plastic material, that is connected to the upwardly pivotable metallic end region disposed within the microgap or the weakening line, that is pivotably attached to the fixed end surface via a pivot bearing, and that is provided with a tear-open member that is upwardly pivotably connected to the closure unit diametrically opposite the pivot bearing, wherein the metallic end region disposed within the peripheral microgap or weakening line is received and held in the opening region of the end, and wherein the tear-open member has an aperture into which a prolongation of the closure unit engages, with the prolongation being so firmly connected to the tear-open member that the prolongation is torn off from the closure unit on the upward pivoting of the tear-off member, and wherein the aperture and the prolongation are provided in the region of the pivot bearing of the tear-open member.

7. The metallic can end in accordance with claim 1, wherein the closure unit is provided with a tear-open member that is upwardly pivotably connected to the closure unit diametrically opposite the pivot bearing.

8. The metallic can end in accordance with claim 1, wherein the sealing and latching ribs form three sealing edges with the reception grooves.

9. The metallic can end in accordance with claim 4, wherein the closure unit is provided with a tear-open member that is upwardly pivotably connected to the closure unit diametrically opposite the pivot bearing.

10. The metallic can end in accordance with claim 6, wherein the sealing frame and the closure unit cooperate in a sealing manner via sealing and latching ribs and associated reception grooves.

11. The metallic can end in accordance with claim 6, wherein the prolongation is so firmly bonded to the tear-open member that the prolongation is torn off from the closure unit on the upward pivoting of the tear-open member.

* * * * *